United States Patent [19]

Fleming et al.

[11] 4,310,209

[45] Jan. 12, 1982

[54] CABLE SHIELD CONNECTING DEVICE

[75] Inventors: Mills L. Fleming, Lawrenceville; George L. Fuchs, Gainesville; Robert H. Gladden, Jr., Norcross; Robert R. Ross, Gainesville, all of Ga.

[73] Assignees: Western Electric Company, Inc., New York, N.Y.; Bell Telephone Laboratories, Inc., Murray Hill, N.J.

[21] Appl. No.: 124,501

[22] Filed: Feb. 25, 1980

[51] Int. Cl.[3] ..... H01R 4/66

[52] U.S. Cl. ..... 339/14 R; 339/97 R; 339/246

[58] Field of Search ..... 174/78; 339/14 R, 14 L, 339/95 R, 177 R, 263 L, 266 G

[56] References Cited

U.S. PATENT DOCUMENTS

| | | | |
|---|---|---|---|
| Re. 28,468 | 7/1975 | Baumgartner et al. | 339/14 L |
| 1,654,838 | 1/1928 | Schroeder et al. | 339/246 X |
| 1,954,587 | 4/1934 | Frank | 339/250 |
| 1,979,091 | 10/1934 | Alsaker et al. | 339/246 |
| 3,499,972 | 2/1967 | Smith | 174/88 |
| 3,676,836 | 7/1972 | Gillemot et al. | 339/97 R |
| 3,701,839 | 10/1972 | Smith | 174/78 |
| 3,732,354 | 5/1973 | Thompson et al. | 174/78 |
| 3,753,204 | 8/1973 | Thompson et al. | 339/14 R |
| 3,757,269 | 9/1973 | Baumgartner et al. | 174/78 X |
| 3,915,540 | 10/1975 | Thompson et al. | 174/78 X |
| 3,924,920 | 12/1975 | Moscioni et al. | 339/246 |
| 4,026,619 | 5/1977 | Gillemot | 339/14 R |
| 4,164,621 | 8/1979 | Silva | 174/78 |

*Primary Examiner*—Eugene F. Desmond
*Attorney, Agent, or Firm*—E. W. Somers

[57] ABSTRACT

A connecting device for providing electrical continuity of a metallic shield of a jacketed distribution cable across a splice location and for electrically and mechanically connecting at least one service wire that is electrically connected to the cable at the splice location and to a customer's premise includes a first clamp which comprises an inner plate that is inserted under the shield until a stud upstanding therefrom abuts the cable jacket and shield. An outer plate of the first clamp and an arcuately formed bonding plate of a second clamp, said bonding plate having a relatively short length in a direction along the length of the cable, are positioned over the cable jacket until the stud extends through an opening in each after which a nut is turned onto the stud to secure the first clamp to the cable and the bonding plate to the first clamp. A stepped clamp plate having a midsection connected to two end sections through offsets and an opening in its midsection is positioned over the stud and cooperates with the bonding plate to form a tortuous path of controlled dimensions through the device for service wires to insure sufficient electrical contact of the second clamp with exposed metallic shields of the service wires while preventing inadvertent movement and undue compression of the service wires.

10 Claims, 6 Drawing Figures

CABLE SHIELD CONNECTING DEVICE

TECHNICAL FIELD

This invention relates to a cable shield connecting device and, more particularly, to a bonding clamp which may be used on each side of a distribution cable splice location in order to provide electrical continuity of a cable shield across the splice location as well as to electrically and mechanically connect shields of secondary cables which incude conductors that are connected to conductors of the distribution cable at the splice location.

BACKGROUND OF THE INVENTION

Cable systems normally include a plurality of discrete cable lengths which are joined together at splice locations and which are joined to other apparatus at terminal points. Each of these discrete cable lengths comprises a multi-conductor core that is enclosed in a metallic shield, and an outer plastic jacket. The electrical shield normally takes the form of an aluminum tape that is wrapped longitudinally about the core to form a tubular member having an overlapped seam.

A metallic shield in telephone cables performs a variety of important functions. Some of these are protection of installers from injury and equipment from damage if a live power line should fall and contact the cable, protection from inductive pickup due to power line voltage, protection from lightning, and suppression of radio frequency pickup. The metallic shield also provides physical protection of the cable core and acts as a barrier to moisture penetration.

To obtain effective shielding from power-line-induced noise, for example, shield continuity must be provided throughout the cable. At splice locations where the cable jacket and shield are removed to expose the individual conductors, it is necessary to provide for continuity of the electrical shield across the splice locations for proper electrical protection of the conductors. Moreover, it is not uncommon for a cable shield to be earth grounded. Connection to the cable shield at splice locations is generally accomplished with a shield clamping device which is referred to in the art as a bond clamp or bonding device.

One prior art bonding device for use in providing electrical cable shield continuity clamps directly onto the relatively thin shield alone; however, such a device tears or damages the thin conductive shield and thereby loses its effectiveness. Another bonding device includes a base which fits beneath the shield and which has a stud protruding outwardly through a slit which is cut in the shield and in the outer jacket. An outer bridge is mounted on the stud to clamp the shield and jacket between the base and the bridge.

A cable shield connector which overcomes the above-mentioned problems comprises an inner plate having an upstanding tab on one end thereof, and an outwardly protruding threaded stud spaced from the tab. The opposite end of the inner plate is slipped under the shield until the stud abuts the ends of the shield and jacket and an outer plate is positioned on the stud over the jacket and forced toward the inner plate by a nut which is turned along the stud. The outer plate first contacts the upstanding tab of the inner plate and tends to pivot thereabout causing the other ends of the plates to tightly clamp the shield and jacket therebetween. Such a cable shield connector is disclosed and claimed in U.S. Pat. No. Re 28,468 which was reissued on July 8, 1975 in the names of R. G. Baumgartner et al.

Shields are also removed from distribution cables at locations in distribution loops where cable conductors are connected to secondary cables having a relatively small number of conductors and that are run from distribution points to subscribers' premises. These secondary cables which are commonly referred to as service wires also include a metallic shield which is covered by an outer plastic jacket and which is connected electrically to the cable shield. Additional consideration must be given to clamping devices for service wires in that provisions must be made for maintaining the compression on the conductors, notwithstanding the cold flow of the plastic insulation with the lapse of time. This greatly reduces the potential for connections becoming loose and hence failing. Moreover, any universal-type clamp device should have the capacity for accommodating plural wires in a cable closure with provisions for applying substantially equal clamping forces to each of the wires of possibly different size. A clamping device for service wires is shown in U.S. Pat. No. 3,924,920 which issued Dec. 9, 1975 in the names of R. J. Moscioni and G. M. Sellar.

In underground closures, it is not uncommon to clamp service wires to a commercially available device which is then connected electrically in some fashion to an exposed shield of a jacketed distribution cable. These devices generally have a bulky profile and are generally arranged in a random fashion by an installer, thereby adding to the size of the closure. Another commercially available device includes a strip of metallic material having a plurality of spaced openings formed therealong. The strip is wrapped about a shield of a service wire so that a stud of a shield bonding clamp such as that shown in hereinbefore mentioned U.S. Pat. No. Re. 28,468 is caused to extend through overlapped aligned openings of the strip after which a nut is turned along the stud.

Clearly, there is a need for a connecting device which is used to reestablish electrical continuity of a shield across a cable splice and which is capable of connecting electrically and mechanically more than one service wire shield to the cable shield while preventing inadvertent movement of the service wires. Seemingly, the prior art does not show a connector which fulfills these needs.

SUMMARY OF THE INVENTION

The foregoing problems are overcome by an electrical connecting device of this invention which comprises a first clamp which is attached to a cable shield. The first clamp includes an inner plate that is curved to the configuration of a cable shield so that it may be inserted under the shield until a threaded post upstanding therefrom abuts a peripheral surface of a cut section of a cable jacket at a splice location. An outer plate having an aperture and being curved to the configuration of the cable jacket is positioned in engagement with the cable jacket so that the post of the inner plate extends through the aperture. The device also includes a second clamp which is used to hold at least one conductive member which is external to the cable and which may be a service wire. The second clamp includes an arcuate bonding plate, having a relatively short length in a direction along a longitudinal axis of the cable, and a lateral portion being formed into a barrel to receive a stranded ground wire and having an opening formed therein. The bonding plate is positioned over the outer plate so that the post extends through the opening. The second clamp further includes a clamp plate which is curved to a configuration to mate with the arcuately shaped bonding plate and includes two spaced legs which straddle and a midsection which is superimposed upon the bonding plate. The clamp plate is stepped with the midsection being spaced outward from and connected to the legs to form a recess for receiving portions of the service wires. Means are also provided for spacing the clamp plate a predetermined distance from the bonding plate to control the configuration of service wires which are clamped therebetween.

The electrical connecting devices of this invention may be used to not only connect a stranded wire across a distribution cable splice and thereby provide electrical continuity, but also to effectively bond service wires. There may be times when two or more of the service wires which are held between the bonding and the clamp plates are of different diameters with the larger one or ones of the wires causing a spacing of the plates so as not to clamp other, smaller diameter ones of the service wires. This problem is overcome by the stepped configuration of the clamp plate which results in the second clamp providing a path having a controlled undulated configuration in the direction along the longitudinal axis of the distribution cable. The clamping of the unjacketed, shielded portions of the service wires along a tortuous path provided between the stepped clamp plate and the bonding plate results in sufficient engagement of the second clamp assembly with all the service wires to provide effective electrical connections with the first clamp and hence with the cable shield.

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
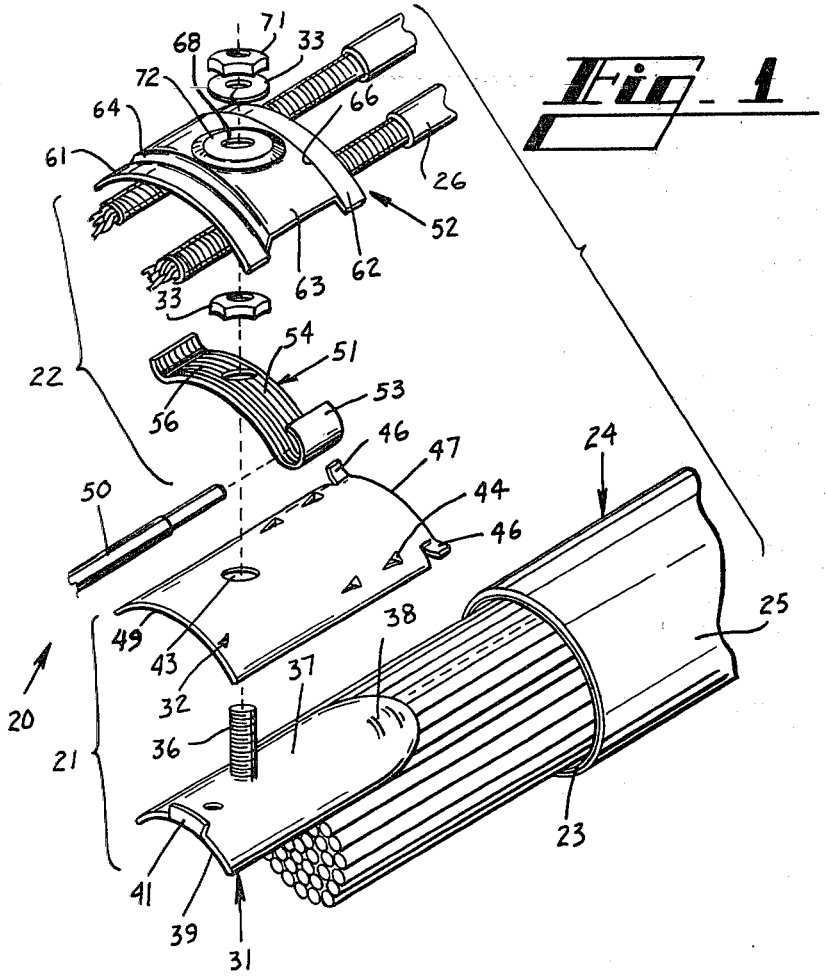
FIG. 1 is an exploded perspective view of a distribution cable and showing a device of this invention for bonding a shield of the cable and for connecting shields of secondary cables to the distribution cable shield.

In FIG. 1 there is shown a connecting device 20 of this invention which is an assembly that includes an inner or shield bonding clamp, designated generally by the numeral 21, and an outer or service wire clamp, designated generally by the numeral 22. The shield bonding clamp 21 is similar to that shown in U.S. Pat. No. Re. 28,468 and is used to establish a connection with a shield 23 of a cable 24 having a jacket 25 on each side of a splice so that electrical continuity may be reestablished (see FIG. 2). The service wire portion 22 is used to establish an electrical connection with service wires 26—26 which are used to carry service from distribution points to subscribers' premises.

As can be seen in FIG. 1, the shield 21 includes an inner plate 31, an outer plate 32 and mounting hardware 33, such as a nut and washer for securing the plate 32 to the plate 31. The plates 31 and 32 are contoured to approximately match the contour of the shield 23 and jacket 25 of the cable, respectively.

The inner plate 31 had a threaded stud 36 integrally fastened thereto by some method such as welding, for example, and projecting upwardly from an outer surface 37 thereof. The outer surface 37 also includes a plurality of serrations 38—38 or other projections which insure suitable electrical contact with an inwardly facing surface of the cable shield 23 when the connector 20 is installed. Also, the end of the inner plate 31 which is inserted into the cable 24 is rounded to facilitate insertion.

In order for the connector 20 to effectively clamp the shield 23 and jacket 25 between the inner and outer plates 31 and 32, one end 39 of the inner plate has an upstanding tab 41 formed integrally therewith. The height of tab 41 is greater than the combined thickness of the jacket 25 and shield 23 of the cable on which the connector 20 is to be installed.

Referring again to FIG. 1, it is seen that the outer plate 32 has an opening 43 through which the stud 36 on the inner plate 31 is inserted. An inner surface of the plate 32 has a plurality of sharp projections or tangs 44—44 which embed in the plastic jacket 25 of the cable over which the outer plate is installed to insure a suitable mechanical bond. The inner and outer plates 31 and 32 are of sufficient length and of suitable configuration and the tangs 44—44 are of sufficient height to insure that the tangs engage the outer surface 37 of the inner plate when the outer plate is installed over the stud 36 (see FIG. 3). This establishes a secured connection between the plates and avoids the disadvantage of some prior art bonding devices in which the outer plate is supported on the plastic jacket. Also, the tangs 44—44 supplement the tab 41 and the stud 36 in providing additional current paths. Plate 32 also has two upstanding tabs 46—46 on another end 47 thereof for retaining a cable clamp on the clamp 21 should it become necessary to install such a clamp around the cable.

Figures 2, 4:
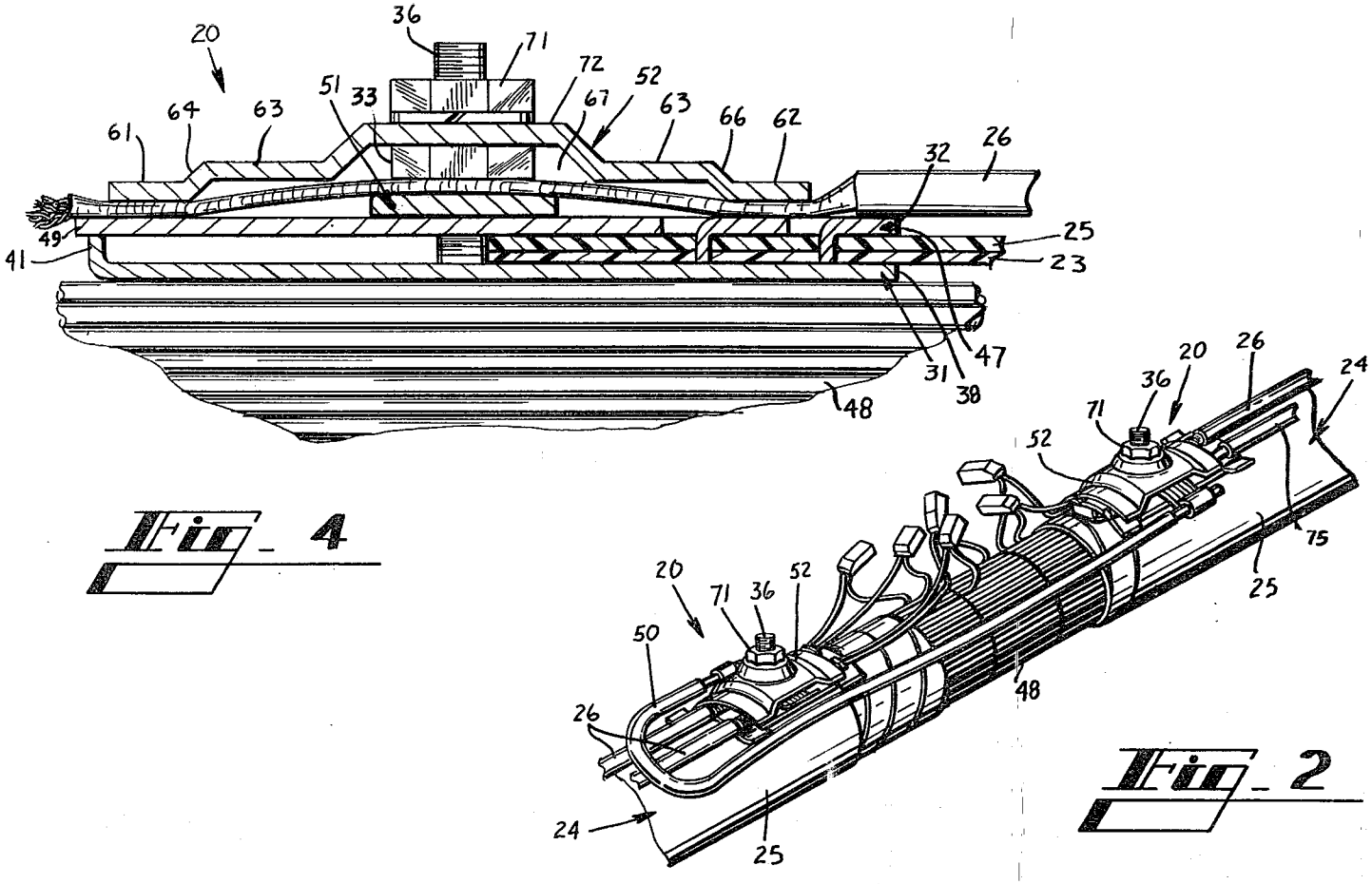
FIG. 2 is a perspective view of a splice location with devices of this invention used to provide continuity across the splice.
FIG. 4 is a side elevated view partially in section showing a device of this invention.

Referring now to FIG. 4, the connector 20 is shown with inner plate 31 inserted in engagement with the inner surface of the shield 23 so that the stud 36 abuts the ends of the outer plastic jacket 25 and the shield. The outer plate 32 is installed over the jacket 25 and a portion of the mounting hardware is then installed on the stud. As the hardware 33 is tightened, the inwardly facing surface on end 49 of the outer plate 32 first engages the tab 41. When the hardware is further tightened, the plate 32 is caused to move pivotally about tab 41 thereby forcing end 38 of plate 31 and end 47 of plate 32 tightly together and clamping the shield 23 and the jacket 25 therebetween. The clamping forces which are imparted by inner and outer plates 31 and 32 are sufficient to prevent the inner plate from slipping from beneath the shield as cable movement is experienced in the field.

The service wire clamp 22 (see FIG. 1) includes provisions not only for holding a plurality of service wires 26—26 but also for connecting an appropriate continuity conductor 50 to the shield 23. Viewing now FIGS. 1 and 4 in particular, there is shown the service wire clamp 22 which includes an arcuately shaped bonding plate 51 and a clamp plate 52. The bonding plate 51 is generally contoured to mate with the outer plate 32 of the shield shield clamp 21 and has a relatively small dimension along the axis of the cable 24.

Figure 3:
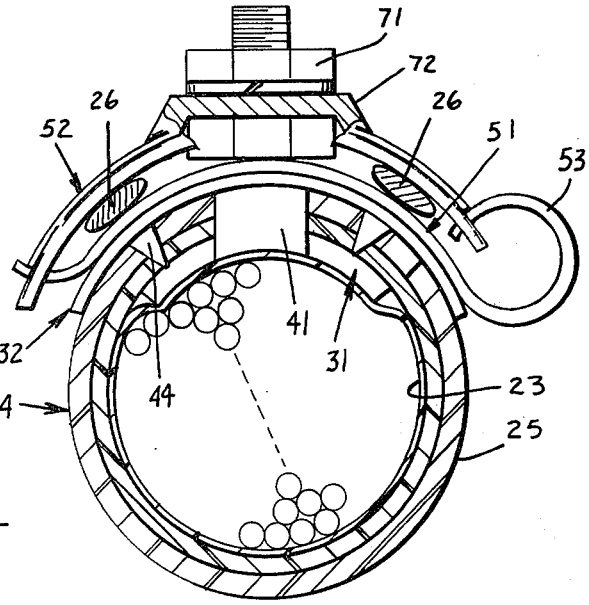
FIG. 3 is an end view of the distribution cable and device of FIG. 1.

Each end of the bonding plate 51 is formed to extend outwardly from the cable 24 with one of those ends being significantly longer than the other so that it can be turned back toward the cable to partially form a barrel 53 as shown in FIGS. 1 and 3. The partially formed barrel 53 is adapted to receive one end of the conductor 50 which extends across the splice. Once the bared end of the conductor 50 is inserted into the opening of the barrel 53, an installer uses a tool (not shown) to crimp the end of the barrel to secure the conductor to the bonding plate 51.

Advantageously, an outer surface 54 of the bonding plate 51 is formed with a plurality of parallel grooves 56—56 which extend transverse of the cable axis from one end of the bonding plate to the other. These grooves 56—56 cause the outer surface 54 of the bonding plate 51 to have an irregular surface which helps to insure electrical engagement with conductors to be positioned thereacross.

The clamp plate 52 of the service wire clamp 22 comprises three arcuately formed interconnected sections-two end legs 61 and 62, which may or may not be of equal length, and a midsection 63. The legs 61 and 62 are integral with the midsection 63 and are connected thereto through offsets 64 and 66 such that the midsection is spaced farther radially from the cable 24 than the legs. This arrangement forms a recess 67 for receiving a portion of each service wire 26 in its undulated configuration when the clamp plate 52 is mounted on the cable 24 with the stud 36 of the inner plate 31 protruding through an aperture 68 in the clamp plate. It is also to be observed that the arcuate length of the midsection 63 is such that the ends of the midsection which extend parallel to the axis of the cable 24 are recessed from the corresponding ends of the legs 61 and 62. This allows the reversely formed ends of the bonding plate 51 to extend through those recesses and assist in preventing relative movement between the bonding and the clamp plate 52.

In order to provide a bearing surface for a nut 71 which is turned along the stud 36 to secure the assembly together, the clamp plate 52 is formed with a boss 72. The boss 72 is formed concentrically about the opening 68 in the clamp plate 52 through which the stud 36 is to extend and has a flat surface to support the nut 71.

The use of the bonding plate 51 and its barrel 53 to connect to the conductor 50 instead of the conventional connection to the stud provides a more suitable electrical connection. Moreover, it has been common to terminate each end of the conductor 50 with suitable hardware such as, for example, eyelets which can be mounted on the stud to make the connection. The diameter of the barrel 53 is such that it allows an installer to insert the bared end of the conductor 50 into the barrel and crimp it with no other special preparations.

The arrangement of the bonding plate 51 and the clamp plate 52 provides excellent electrical connection with service cables which are routed therebetween. It will be observed from FIG. 4 that longitudinally along the cable axis, the passageway between the bonding plate 51 and the clamp plate 52 is a tortuous one caused by the form of the clamp plate in cooperation with the bonding plate. Should one or more of the service wires 26—26 have a larger cross section than the other or others, electrical engagement of the plates with the other service wires will still be assured because of the path past the offsets 64—66 of the clamp plate 52. It should be apparent that instead of being secured within the barrel 53, the conductor 50 or an earth ground conductor 75 (see FIG. 2) could be clamped between the bonding plate 51 and the clamp plate 52 as are one or more service wires 26–26 or could be connected to the stud 36 as shown in U.S. Pat. No. 28,468.

The device 20 of this invention not only provides an electrical connection to the cable shield 23 and to one or more service wire shields, but it also provides a mechanical connection of the service wires 26—26 to the cable 24. Further, this mechanical connection which unlike some prior art devices prevents inadvertent movement of the service wires is controlled to avoid undue compression of the service wires. This is accomplished by controlling the travel of the nut 33 along the stud 36 to space the outer plate 52 a predetermined distance from the bonding plate 51. After the service wires 26 have been positioned between the bonding plate 51 and the outer plate 52, the nut 71 is turned onto the stud 36 to move the outer plate toward the bonding plate. This causes the service wires 26—26 to be compressed but in a controlled manner since the nut 33 limits the travel of the plate 52.

Figure 5:
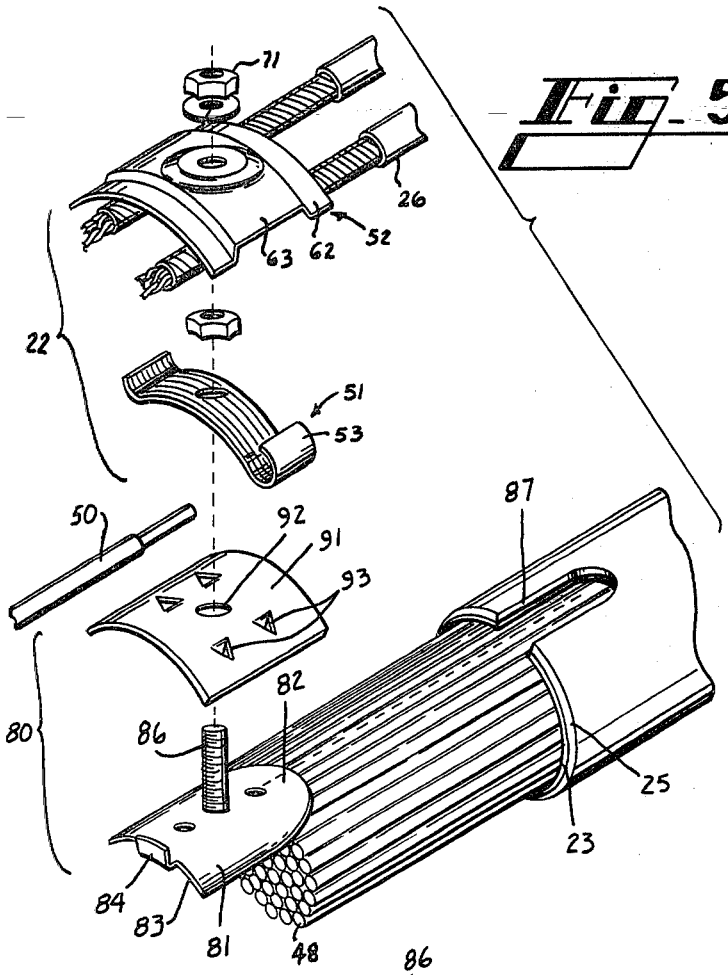
FIG. 5 is an exploded perspective view of a distribution cable at a splice location and showing an alternative embodiment of a device in accordance with this invention for bonding a shield of a cable and for connecting shields of service wires to the shield of the distribution cable.
Figure 6:
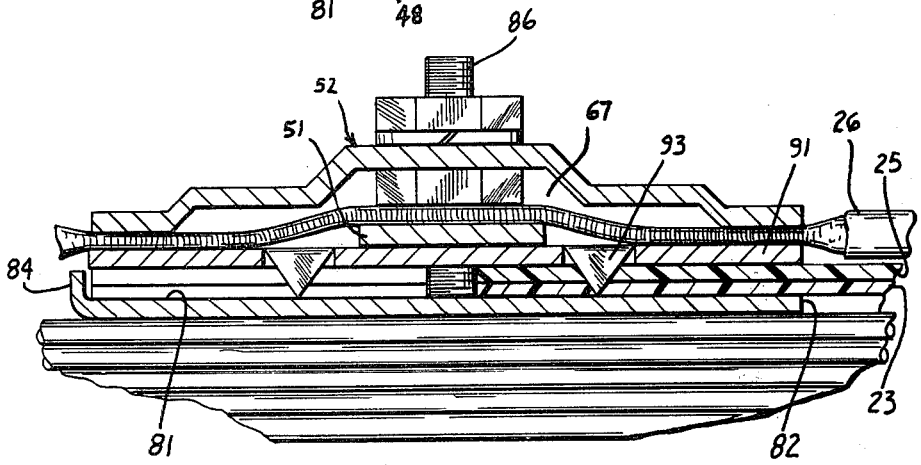
FIG. 6 is a side elevational view partially in section showing the device of FIG. 5.

In an alternative embodiment of this invention, a cable shield clamp designated generally by the numeral 80 (see FIGS. 5–6) includes an inner plate 81 having an inner rounded end 82 and an outer end 83 having a tab 84 upstanding therefrom. Unlike the inner plate 31 of the subassembly 21, the inner plate 81 has a threaded post 86 upstanding therefrom and is located generally midway between the ends of the plate 81. The central location of the post 86 provides the portion 80 with a different kind of clamping action by means of a simple beam loading. In order to accomplish this and preparatory to the insertion of the plate 81 under the cable shield 23, a slit 87 is made in the cable shield 23 and jacket 25 extending inwardly from the exposed peripheral ends of each. Then the inner plate 81 is inserted under the shield and the post 86 moved into the slit until the tang 84 is aligned with the peripheral end of the jacket 25.

The shield clamp 80 also includes an outer plate 91 which is modified to dispose an aperture 92 centrally thereof to receive the post 86 when the outer plate is placed in engagement with the cable jacket. It should also be observed from FIG. 5 that the outer plate 91 is formed with a plurality of tangs 93—93 which are distributed on each side of the aperture 92. These tangs 93—93 like those 44—44 of the shield clamp 21 are caused to penetrate the jacket 25 and come to rest in engagement with the inner plate 81 when the service wire clamp 22 is assembled over the post 86. The service wire clamp which is assembled with the cable shield clamp 80 is the same service wire portion 22 which is assembled with the preferred embodiment cable shield clamp 21 of this invention.

It is to be understood that the above-described arrangements are simply illustrative of the invention. Other arrangements may be devised by those skilled in the art which will embody the principles of the invention and fall within the spirit and scope thereof.

What is claimed is:

1. A device for providing an electrical connection to a metallic shield of a cable, having a plurality of conductors enclosed by the shield an an overlying protective jacket, and for providing an electrical connection to at least one conductive member external to the cable, said device comprising:

a first clamp which comprises an inner metallic plate having a metallic post upstanding therefrom and an outer plate having an opening therein for receiving said post for establishing an electrical connection with a metallic shield of a cable, said first clamp adapted to be attached to the cable with said inner plate engaging the shield and said outer plate engaging an outwardly facing surface of the cable jacket to interpose a portion of the shield and of the overlying jacket between said inner and said outer plates;

a second clamp which is adapted to be secured to said first clamp in engagement with said outer plate and which includes means for holding at least one conductive member external to the cable in a clamped tortuous configuration and for controlling the clamped configuration through longitudinal and end sections of each said conductive member to prevent inadvertent movement of each said conductive member while preventing undue compression thereof, said second clamp including a bonding plate having an aperture therein, said bonding plate adapted to be seated in engagement with said outer plate of said first clamp with said post extending through the aperture of said bonding plate, and an outer clamp which is adapted to be secured to said bonding plate; and fastening means for attaching said first clamp to the cable with a portion of a shield and overlying jacket clamped between said inner and outer plates thereof and for securing said second clamp to said first clamp to hold said at least one conductive member in said clamped configuration, said fastening means being effective to control the securing of said second clamp to said first clamp without undue compression of each said conductive member.

2. The device of claim 1, wherein said bonding plate has a length in a direction along a longitudinal axis of the cable which is substantially less than the length of said outer clamp plate, said outer clamp plate having a stepped configuration to form a recess for each said conductor when said second clamp is secured to said first clamp, said bonding plate and said outer clamp plate when secured to said first clamp being effective to provide the tortuous path for the at least one conductive member.

3. A device for providing an electrical connection to a shield of a cable, the cable having a plurality of conductors enclosed by the shield and a protective jacket overlying the shield, the jacket and the shield having discontinuities to form ends, said device providing an electrical connection to at least one conductive member external to the cable, said device comprising:

a first plate which is made of a conductive material and which has inner and outer major surfaces and first and second ends, said first plate adapted to have said first end thereof inserted into said cable at one of the discontinuities in engagement with the shield and said second end extending away from said one discontinuity;

a post attached to said first plate and upstanding therefrom;

a second plate which is made of a conductive material and which has first and second ends corresponding to said first and second ends of said first plate, said second plate having an opening therethrough, said second plate being adapted to be mounted in engagement with an outwardly facing surface of the cable jacket with said post extending through said opening and adapted to be moved toward said first plate;

a third plate which is made of a conductive material and which is arcuately formed, said third plate being adapted to engage said outwardly facing major surface of said second plate and having an aperture for receiving said post;

a fourth plate which is made of a conductive material and which is arcuately formed with one portion of its length offset from a remaining portion of its length to cooperate with said third plate to form a recess for holding the at least one conductive member in a tortuous path to clamp the at least one conductive member between said third and fourth plates; and fastening means engaging said post for causing said second plate to be moved toward said first plate to cause said first and second plates to be attached to said cable with a portion of the shield and overlying protective jacket secured therebetween, for securing said third plate to said second plate, and for moving said fourth plate toward said third plate to hold the at least one conductive member in said tortuous path.

4. The device of claim 3, wherein a tab is formed on a second end of said first plate, said tab having a height which is greater than the combined thickness of the shield and the overlying jacket.

5. The device of claim 3, wherein said third plate extends along said cable a distance substantially less than said first and second plates.

6. The device of claim 5, wherein said fourth plate is formed with a midsection and two end legs, said midsection and said legs being arcuate and offset radially from each other, said fourth plate and said third plate providing said tortuous path for said at least one conductive member.

7. The device of claim 3, wherein one of said devices is adapted to engage the cable on each side of a splice location with said first plate of each device adapted to be inserted in engagement with the cable shield and the second plate of each device is adapted to engage the cable jacket on one side of the splice location and wherein one free end of said third plate includes means for receiving an end of a conductor which extends across said splice location to establish electrical contact between the conductor and each shield discontinuity to electrically connect the shield across the splice location.

8. The device of claim 7, wherein said means of said third plate for receiving the conductor includes a ferrule which is formed on one side of said third plate.

9. A device for providing electrical connection to a shield of a cable, the cable having a plurality of conductors enclosed by the shield and a protective jacket overlaying said shield, said shield and said jacket having a combined thickness and having discontinuities therein to form ends, said device also providing a connection between said shield and conductive members external to the cable, said device comprising:

a first plate which is made of conductive material and which has inner and outer major surfaces and first and second ends;

a post attached to said first plate and upstanding therefrom, said first plate adapted to have said first end inserted into said cable in engagement with said shield so that said post abuts said ends of said jacket and shield and said second end extending away from said ends along said cable;

a second plate which is made of a conductive material and which has inner and outer surfaces and first and second ends corresponding to said first and second ends of said first plate, said second plate having an aperture therethrough and adapted to be mounted in engagement with an outwardly facing surface of the cable jacket with said post extending through said aperture and adapted to be moved toward said first plate;

a tab projecting from a second end of one of said first and second plates, said tab having a height greater than said combined thickness and being adapted for engaging said second end of the other of said plates when said second plate is moved toward said first plate to provide a pivot on said second ends so that said first ends of said first and second plates clamp together with a portion of the jacket and the shield clamped between said first ends when said first and second plates are installed on said cable at one of said discontinuities;

a third plate made of a conductive material and arcuately formed, said third plate being adapted to engage said outwardly facing major surface of said second plate and having an aperture for receiving said post;

a fourth plate made of a conductive material and being arcuately formed with one portion of its length offset from a remaining portion of its length to provide a recess for receiving a portion of at least one conductive member and for cooperating with said third plate to clamp said at least one conductive member in an undulated configuration between said third and said fourth plates; and fastening means engaging said post for moving said second plate toward said first plate and for moving said fourth plate toward said third plate to clamp said at least one conductive member between said third and fourth plates.

10. A connector assembly for providing an electrical connection of a conductor and of service wires to a shield of a cable having a plurality of conductors enclosed within the shield and a protective jacket over said shield, said shield and said jacket having a combined thickness and having discontinuities therein to form ends, said connection comprising in combination;

a cable shield-clamping portion which comprises:

an inner plate of conductive material having inwardly and outwardly facing surfaces and first and second ends;

a threaded stud made of a conductive material and mounted on said inner plate and upstanding therefrom, said inner plate adapted to have said first end inserted into said cable in contact with said shield so that said stud abuts said ends of the jacket and shield and said second end extends away from said ends along said cable;

an outer plate made of a conductive material having inwardly and outwardly facing surfaces and having first and second ends corresponding to said first and second ends of said inner plate and adapted for installation on said stud over the exterior of the jacket;

mounting means engaging said stud for moving said outer plate toward said inner plate; and a tab on said second end of one of said plates oriented at substantially a right angle with respect to said surfaces of said one plate, said tab having a height greater than said combined thickness and being adapted for contacting said second end of the other of said plates when said outer plate is forced toward said inner plate to provide a pivot on said second ends so that said first ends clamp a portion of the jacket and the shield therebetween; and a service wire clamping portion which comprises:

a bonding plate arcuately shaped, having an opening therein for receiving said stud and having a length as measured along an axis of the cable which is substantially less than that of the inner and outer plates of said shield clamping portion, with one end of the bonding plate being formed into a sleeve for receiving a conductor;

a clamp plate arcuately shaped having an opening therein for receiving said stud and having a midsection which is offset from two end sections to form an undulated configuration which cooperates with the bonding plate to provide a tortuous path for each of a plurality of service wires; and means for moving said clamp plate toward said bonding plate to secure the service wires therebetween and to said shield clamping portion to establish an electrical connection of the service wires and conductor to the cable shield.

* * * * *